US005192823A

United States Patent [19]

Suzuki et al.

[11] Patent Number: 5,192,823

[45] Date of Patent: Mar. 9, 1993

[54] MUSICAL TONE CONTROL APPARATUS EMPLOYING HANDHELD STICK AND LEG SENSOR

[75] Inventors: Hideo Suzuki; Masao Sakama, both of Hamamatsu, Japan

[73] Assignee: Yamaha Corporation, Hamamatsu, Japan

[21] Appl. No.: 417,788

[22] Filed: Oct. 4, 1989

[30] Foreign Application Priority Data

Oct. 6, 1988 [JP] Japan ..... 63-252377

[51] Int. Cl.[5] ..... G10H 5/02

[52] U.S. Cl. ..... 84/600; 84/659

[58] Field of Search ..... 84/477 B, 484, 600, 84/622-625, 644-645, 659-661, 670, 692-700, 723, 735, 736, 711, 738, 718, 730, DIG. 7, 12; 128/779

[56] References Cited

U.S. PATENT DOCUMENTS 4,341,140 7/1982 Ishida .
4,627,324 12/1986 Zwosta ..... 84/694
4,753,146 6/1988 Seiler .
4,776,253 10/1988 Downes ..... 84/645
4,860,364 8/1989 Giannini ..... 381/90
4,909,117 3/1990 Reiling et al. ..... 84/738
4,995,294 2/1991 Kashic et al. ..... 84/738

FOREIGN PATENT DOCUMENTS 264782 4/1988 European Pat. Off. .

*Primary Examiner*—William M. Shoop, Jr.
*Assistant Examiner*—Jeffrey W. Donels
*Attorney, Agent, or Firm*—Graham & James

[57] ABSTRACT

A musical tone control apparatus includes at least one stick to be held by a person's hand and at least one detector to be attached to a person's leg. The stick and detector are respectively equipped with sensors each detecting a physical parameter accompanied with a spatial displacement thereof. Preferably, the sensor is constructed by an acceleration sensor for detecting an acceleration as the physical parameter. Based on detection results of the sensors, a generation of a muscial tone is controlled when the stick and detector are swung with the swinging motions of the person's arm and leg. In addition, a switch is provided to the stick, by which a tone color of the musical tone to be generated is controlled in response to an operation of this switch. Preferably, the musical tone control apparatus can provide two sticks to be held by both hands and two detectors to be attached to both legs.

8 Claims, 4 Drawing Sheets

| SW 13a | SW 13b | RIGHT HAND K01 | LEFT HAND K02 | RIGHT LEG K03 | LEFT LEG K04 |
|---|---|---|---|---|---|
| OFF | OFF | TAM1 | TAM2 | SNARE DRUM | BASS DRUM |
| OFF | ON | SYNTHESIZER TAM1 | SYNTHESIZER TAM2 | SYNTHESIZER SNARE | SYNTHESIZER BASS |
| ON | OFF | HI-HAT OPEN | HI-HAT CLOSE | AGOGO LOW | AGOGO HIGH |
| ON | ON | CONGA HIGH | CONGA LOW | BONGO HIGH | BONGO LOW |

| S W 13a | S W 13b | RIGHT HAND K01 | LEFT HAND K02 | RIGHT LEG K03 | LEFT LEG K04 |
|---|---|---|---|---|---|
| OFF | OFF | TAM1 | TAM2 | SNARE DRUM | BASS DRUM |
| OFF | ON | SYNTHESIZER TAM1 | SYNTHESIZER TAM2 | SYNTHESIZER SNARE | SYNTHESIZER BASS |
| ON | OFF | HI-HAT OPEN | HI-HAT CLOSE | AGOGO LOW | AGOGO HIGH |
| ON | ON | CONGA HIGH | CONGA LOW | BONGO HIGH | BONGO LOW |

FIG. 4

MUSICAL TONE CONTROL APPARATUS EMPLOYING HANDHELD STICK AND LEG SENSOR

BACKGROUND OF THE INVENTION

1. Field of the Invention

The present invention relates to a musical tone control apparatus for controlling a musical tone in response to a motion of a human body.

2. Prior Art

According to the conventional apparatus as disclosed in Japanese Patent Laid-Open Publication No. 63-132295, an acceleration sensor is equipped within a stick and one operation switch is provided in the vicinity of a grip portion of this stick. This acceleration sensor detects the swinging motion of the stick, so that the generation of the musical tone is controlled based on its detection result. Then, a tone color of this musical tone to be generated is changed over in response to the operation of the operation switch.

According to this conventional apparatus, the performer can merely control the generation of the musical tone in response to the motion of his arm by holding and swinging the stick. However, this apparatus cannot generate the musical tone when the performer moves his legs in a dance or a rhythm exercise. Therefore, the music performed by use of this apparatus must be monotonous. Moreover, it is impossible to enjoy the music corresponding to the motion of whole body in this dance or rhythm exercise, which is performed by this apparatus.

SUMMARY OF THE INVENTION

It is accordingly a primary object of the present invention to provide a musical tone control apparatus by which it is possible to enjoy the varied music corresponding to the motion of the whole body in the dance or rhythm exercise.

In a first aspect of the present invention, there is provided a musical tone control apparatus comprising:

(a) a stick having a shape which can be held by a person's hand, the stick being provided with a first sensor and at least one switch, the first sensor detecting a physical parameter accompanied with a spatial displacement of the stick to be moved with a motion of a person's arm;

(b) detecting means to be mounted to a person's leg, the detecting means being provided with a second sensor for detecting a physical parameter accompanied with a spatial displacement of the detecting means to be moved with a motion of the person's leg;

(c) musical tone generation control means for generating a musical tone generation control signal for controlling a generation of a musical tone based on detection results of the first and second sensors; and (d) tone color control means for generating a tone color control signal for controlling a tone color of the musical tone whose generation is controlled by the musical tone generation control signal in response to an operation of the switch.

In a second aspect of the present invention, there is provided a musical tone control apparatus comprising:

(a) a pair of sticks each having a shape which can be held by a person's hand, the stick being provided with a first sensor and at least one switch, the first sensor detecting a physical parameter accompanied with a spatial displacement of the stick to be moved with a motion of a person's arm;

(b) a pair of detecting means each mounted to a person's leg, each of the detecting means being provided with a second sensor for detecting a physical parameter accompanied with a spatial displacement of the detecting means to be moved with a motion of the person's leg;

(c) musical tone generation control means for generating a musical tone generation control signal each controlling a generation of a musical tone based on each of detection results of the first and second sensors; and (d) tone color control means for generating a tone color control signal for controlling a tone color of the musical tone whose generation is controlled by the first to fourth musical tone generation control signals in response to a operation combination of the switches which are provided to the sticks.

In a third aspect of the present invention, there is provided a musical tone control apparatus comprising:

(a) a stick having a shape which can be held by a person's hand, the stick being provided with a first acceleration sensor and at least one switch, the first acceleration sensor detecting an acceleration applied to the stick to be moved with a motion of a person's arm;

(b) detecting means to be mounted to a person's leg, the detecting means being provided with a second acceleration sensor for detecting an acceleration applied to the detecting means to be moved with a motion of the person's leg;

(c) means for generating a key-on signal when the acceleration detected by the first acceleration sensor exceeds over a first predetermined value or when the acceleration detected by the second acceleration sensor exceeds over a second predetermined value, wherein the first predetermined value is set different from the second predetermined value; and (d) tone color control means for controlling a tone color of a musical tone in response to an operation of the switch, whereby the musical tone having a desirable tone color is generated in accordance with the key-o signal.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIG. 4 shows the contents of a musical tone control table 37 shown in FIG. 3.

DESCRIPTION OF A PREFERRED EMBODIMENT

[A] Configuration of an Embodiment

Figure 1:
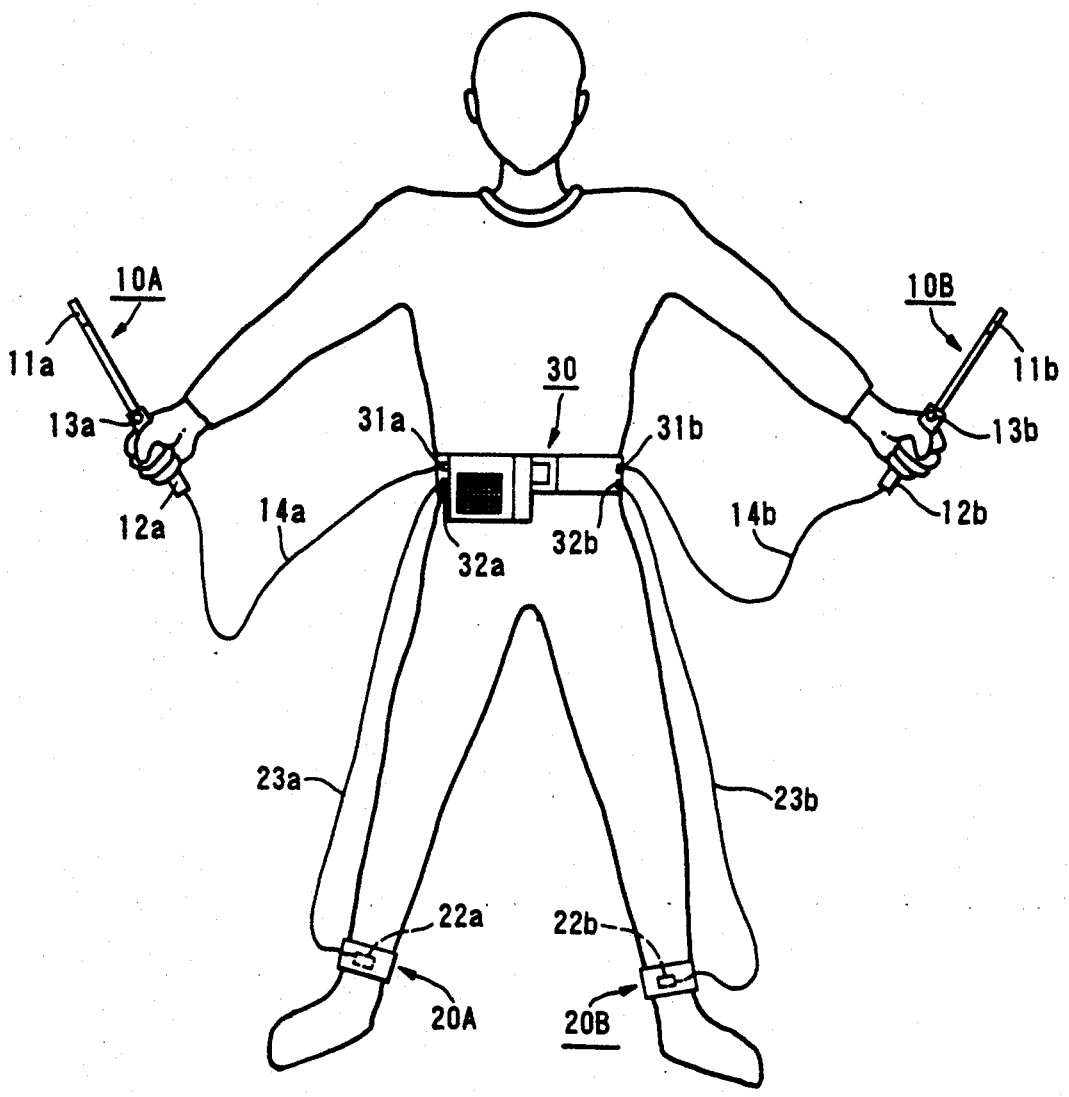
FIG. 1 is a front view of the performer to whom the musical tone control apparatus according to an embodiment of the present invention is mounted.

Referring now to the drawings, wherein like reference characters designate like or corresponding parts throughout the several views, FIG. 1 is a front view of the performer to whom the musical tone control apparatus according to an embodiment of the present invention is mounted. In FIG. 1, the performer holds sticks 10A, 10B respectively by his right and left hands, attaches leg rings 20A, 20B respectively at his right and left legs and also puts on a belt around his waist.

Figure 2:
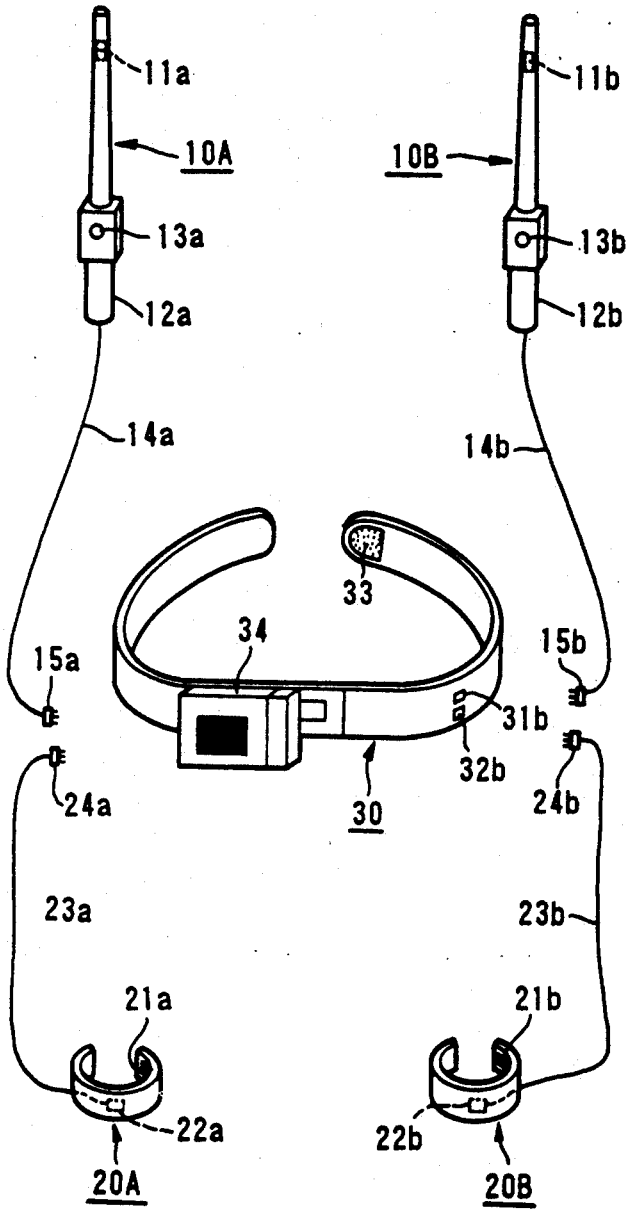
FIG. 2 is a perspective view of the musical tone control apparatus as illustrated in FIG. 1.
Figure 3:
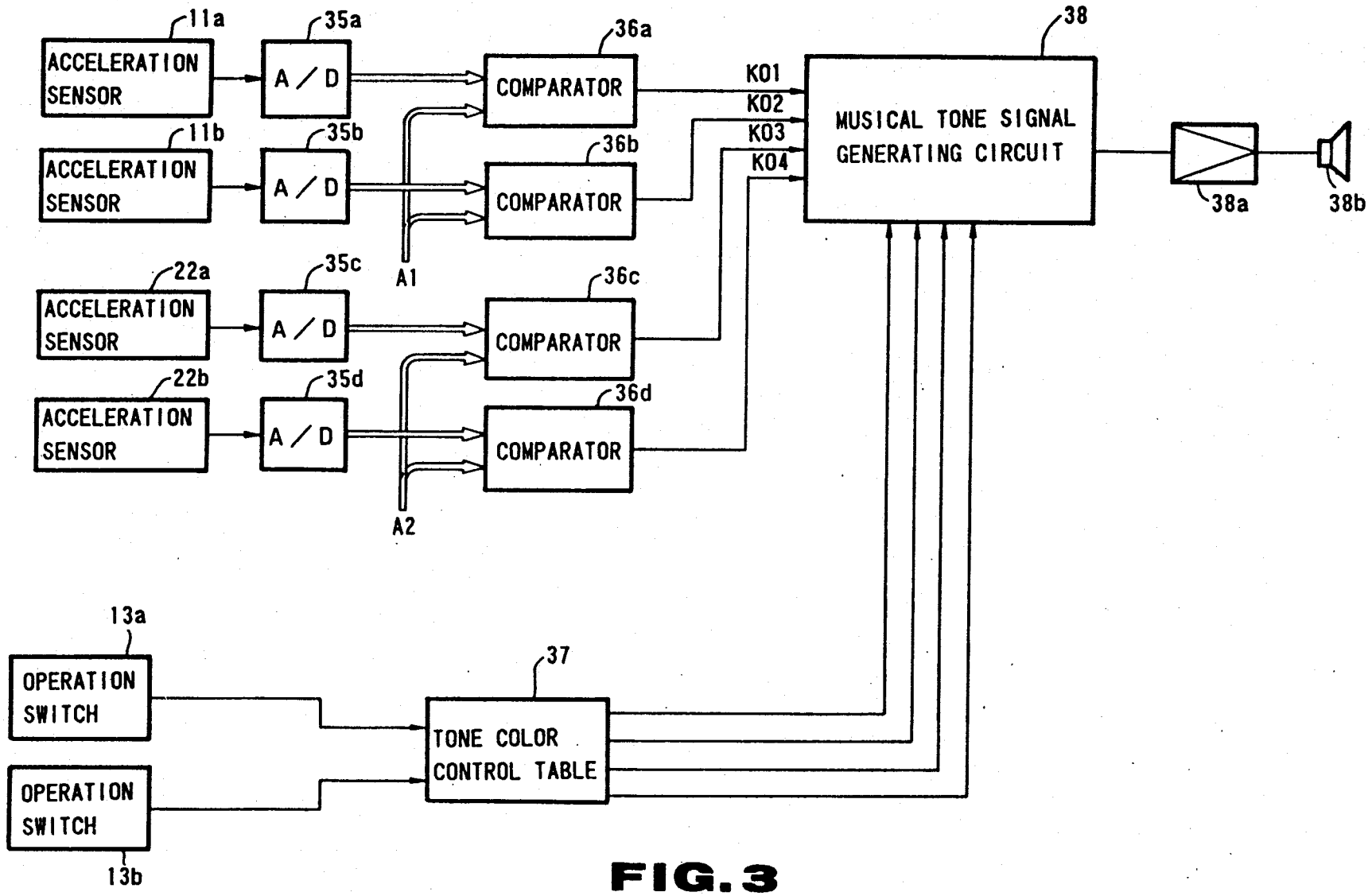
FIG. 3 is a block diagram showing an electric configuration of the musical tone control apparatus according to an embodiment of the present invention.

As shown in FIGS. 1 and 2, acceleration sensors 11*a*, 11*b* are respectively equipped within tip edge portions of the sticks 10A, 10B. In addition, these sticks 10A, 10B are equipped with operation switches 13*a*, 13*b* above its grip portions 12*a*, 12*b*. These acceleration sensors 11*a*, 11*b* respectively detect accelerations corresponding to spatial displacements applied to the tip edge portions of the sticks 10A, 10B. Then, the acceleration sensor outputs an analog acceleration signal indicative of the detected acceleration. The analog acceleration signal from the acceleration sensor 11*a* is outputted via a lead 14*a* drawn from a lower edge of the grip portion 12*a*, while another analog acceleration signal from the acceleration sensor 11*b* is outputted via a lead 14*b* drawn from a lower edge of the grip portion 12*b*. Each of the operation switches 13*a*, 13*b* is operated on/off so that it outputs an on/off signal. The on/off signal of the operation switch 13*a* is outputted via the lead 14*a*, while that of the operation switch 13*b* is outputted via the lead 14*b*. This operation switch can be constructed as a mechanical switch which latches its on/off operations or another electric switch which latches its on/off operations by alternatively changing over the on/off signal when it is repeatedly depressed. The leads 14*a*, 14*b* are respectively connected to connectors 15*a*, 15*b*, which are further to be respectively connected to connectors 31*a*, 31*b* formed on the belt 30.

The band-shaped leg rings 20A, 20B are respectively linked together into the rings by fastenings 21*a*, 21*b*. In addition, acceleration sensors 22*a*, 22*b* are respectively equipped within center portions of the leg rings 20A, 20B. These acceleration sensors 22*a*, 22*b* respectively detect accelerations corresponding to spatial displacements of the leg rings 20A, 20B. Then, the acceleration sensors 22*a*, 22*b* respectively output analog acceleration signals indicative of the detected accelerations applied to the leg rings 20A, 20B. The analog acceleration signal of 22*a* is outputted via a lead 23*a*, while that of 22*b* is outputted via a lead 23*b*. These leads 23*a*, 23*b* are respectively connected to connectors 24*a*, 24*b*, which are further to be respectively connected to connectors 32*a*, 32*b* formed on the belt 30.

The belt 30 is also shaped like a band, and both edges thereof are linked together by a fastening 33. At the center portion of this belt 30, a case 34 is attached. This case 34 contains analog-to-digital converters (i.e., A/D converters) 35*a* to 35*d*, comparators 36*a* to 36*d*, a tone color control table 37 corresponding to a tone color control means for controlling the tone color of the musical tone to be generated, and a musical tone signal generating circuit 38 for generating the musical tone.

The A/D converters 35*a*, 35*b*, 35*c*, 35*d* are respectively connected to the connectors 31*a*, 31*b*, 32*a*, 32*b* which are further connected to the acceleration sensors 11*a*, 11*b*, 22*a*, 22*b*. Therefore, the A/D converters 35*a*, 35*b*, 35*c*, 35*d* converts the analog acceleration signals from the acceleration sensors 11*a*, 11*b*, 22*a*, 22*b* into digital acceleration signals respectively. These digital acceleration signals from 35*a* to 35*d* are respectively fed to first inputs of the comparators 36*a* to 36*d*. Meanwhile, a threshold value Al which is used for generating the musical tone is inputted into second inputs of the comparators 36*a*, 36*b*, while another threshold value A2 other comparators 36*c*, 36*d*. When the digital acceleration signals from the A/D converters 35*a*, 35*b* are respectively larger than the threshold value A1, the comparators 36*a*, 36*b* respectively output key-on signals KO1, KO2. Similarly, when the digital acceleration signals from the A/D converters 35*c*, 35*d* are respectively larger than the threshold value A2, the comparators 36*c*, 36*d* respectively output key-on signals KO3, KO4. These signals KO1 to KO4 are respectively fed to the musical tone signal generating circuit 38. These threshold values A1, A2 respectively correspond to the arms and legs. Since the motions of the arms are different from those of the legs, these threshold values A1, A2 are set different from each other.

The tone color control table 37 is provided for controlling the kind (i.e., tone color) of the percussion tone in response to the combination of the on/off operations of the operation switches 13*a*, 13*b*, wherein the percussive tone is to be generated in response to the key-on signals KO1 to KO4. Therefore, this table 37 inputs the on/off signals from the operation switches 13*a*, 13*b* to thereby generate a tone color control signal indicative of the kind of the percussive tone to be selected as indicated in FIG. 4, for example.

In response to the arrivals of the key-on signals KO1 to KO4 from the comparators 36*a* to 36*d*, the musical tone signal generating circuit 38 generates the musical tone signal, whose kind (i.e., tone color) is controlled by the tone color control signal from the tone color control table 37. This kind of the musical tone signal is as shown in FIG. 4. Then, the output of the musical tone signal generating circuit 38 is fed to a speaker 38*b* via an amplifier 38*a*.

[B] Operation of an Embodiment

Next, description will be given with respect to the operation of an embodiment which is configured as described above.

At first, the person (i.e., performer) who dances or rings 20A, 20B at his right and left legs by use of the fastenings 21*a*, 21*b*. Then, the performer attaches the belt 30 at his waist by use of the fastening 33. Thereafter, the connectors 15*a*, 15*b* are connected to the connectors 31*a*, 31*b*; the connectors 24*a*, 24*b* are connected to the connectors 32*a*, 32*b*; and the performer holds the sticks 10A, 10B by his right and left hands.

In this state where the performer completely attaches the musical tone control apparatus as illustrated in FIG. 1, when the performer swings up and down the sticks 10A, 10B by swinging up and down his right and left arms, the acceleration sensors 11*a*, 11*b* detect the accelerations corresponding to the spatial displacements applied at the tip edge portions of the sticks 10A, 10B, so that they output the analog acceleration signals indicative of the detected acceleration applied to the sticks 10A, 10B. These analog acceleration signals are converted into the digital acceleration signals by the A/D converters 35*a*, 35*b*. When the digital acceleration signals from the A/D converters 35*a*, 35*b* exceed over the threshold value A1, the comparators 36*a*, 36*b* output the key-on signals KO1, KO2 to the musical tone signal generating circuit 38. Based on the key-on signals KO1, KO2, this circuit 38 generates the musical tone signal.

In this stage, the tone color control table 37 outputs the tone color control signal indicative of the kind of the percussive tone in response to the operation combination of the switches 13*a*, 13*b*, as shown in FIG. 4.

Thus, the musical tone signal generating circuit 38 generates the musical tone signal corresponding to the percussion instrument indicated by the tone color control signal. For example, in the case where both of the operation switches are turned off, the musical tone signal generating circuit 38 outputs the musical tone signal having the tone color of "tam 1" in response to the swinging motion of the performer's right arm, i.e., the spatial displacement of the stick 10A. On the other hand, the musical tone signal generating circuit 38 outputs the musical tone signal having the tone color of "tam 2" in response to the swinging motion of the performer's left arm, i.e., the spatial displacement of the stick 10B, wherein the musical instrument of "tam 1" is identical to that of "tam 1", however, the tone color of "tam 2" is different from that of "tam 1". In another case where the operation switch **13*a* is turned off but the operation switch 13*b* is turned on, the musical tone signal generating circuit 38 outputs the musical tone having the tone color of "synthesizer tam 1" in response to the swinging motion of the right arm, i.e., the spatial displacement of the stick 10A. On the other hand, the musical tone signal generating circuit 38 outputs the musical tone signal having the tone color of "synthesizer tam 2" in response to the swinging motion of the left arm, i.e., the spatial displacement of the stick 10B. Herein, the musical instrument of "synthesizer tam 1" is identical to that of "synthesizer tam 2", however, the tone colors are different from each other. Such musical tone signal is fed to the speaker 38*b* via the amplifier 38*a***. Thus, the musical tone signal in response to the swinging motion of the right or left arm.

Meanwhile, when the performer swings the leg ring 20A or 20B by moving the right or left leg forward and backward, or by moving the leg up and down, the acceleration sensor **22*a* or 22*b* detects the acceleration corresponding to the spatial generate the analog acceleration signal indicative of the detected acceleration. This analog acceleration signal is converted into the digital acceleration signal by the A/D converter 36*c* or 36*d*. When the digital acceleration signal exceeds over the threshold value A2, the comparator 36*a* or 36*b* outputs its key-on signal KO3 or KO4 to the musical tone signal generating circuit 38. Thus, the musical tone signal generating circuit 38 generates the musical tone signal in response to the key-on signal KO3 or KO4. In this case, the tone color control table 37, as shown in FIG. 4, controls the tone color of the musical tone signal generated by the circuit 38 in response to the operation combination of the switches 13*a*, 13*b*. Thereafter, the speaker 38*b* sounds the musical tone corresponding to the musical tone signal. Thus, for example, in the case where both of the operation switches 13*a*, 13*b* are turned off, the speaker 38*b* sounds the musical tone having the tone color of "snare drum" in response to the motion of the right leg, i.e., the spatial displacement of the leg ring 20A. On the other hand, the speaker 38*b* sounds the musical tone having the tone color of "bass drum" in response to the motion of the left leg, i.e., the spatial displacement of the leg ring 20B. Meanwhile, in the case where the operation switch 13*a* is turned off but the operation switch 13*b* turned on, the speaker 38*b* sounds the musical tone having the tone color of "synthesizer snare" in response to the spatial displacement of the leg ring 20A, while it sounds the musical tone having the tone color of "synthesizer bass" in response to the spatial displacement of the leg ring 20B**.

As described heretofore, the present embodiment can control the generations of four kinds of percussive tones in response to the motions of both hands and both legs. Then, the kind of the percussive tone to be sounded is controlled based on the operation combination of the operation switches **13*a*, 13*b* provided to the sticks 10A, 10B**. Therefore, maximum sixteen kinds of the varied percussive tones can be sounded in response to the operations by both hands and both legs. Thus, it is possible to enjoy the varied music in response to the motions of the whole body in the dance, rhythm exercise etc.

[C] Modified Examples

The present invention can be modified as follows.

(1) The present embodiment provides one pair of the sticks 10A, 10B and one pair of the leg rings 20A, 20B. However, it is possible to modify the present embodiment to provide only one stick and one leg ring, which are respectively mounted to one hand and one leg. This modified example can also vary and control the kinds of the percussive tones to be sounded in response to the spatial displacements of the stick and leg ring, based on the operation of the switch provided to the stick. The number of the kinds of percussive tones which can be sounded by this modified example is smaller than that of the kinds of percussive tones which can be sounded by the present embodiment. However, this modified example can control the generations of the varied percussive tones in response to the motion of leg in addition to the motion of hand, so that it becomes possible to enjoy the varied music corresponding to the motions of the whole body.

(2) The present embodiment provides one switch (**13*a*, 13*b* ) per one stick (10A, 10B). However, it is possible to provide plural operation switches to one stick. In this case, the tone color control table 37 is re-designed to control the kinds of the percussive tones to be formed in the musical tone signal generating circuit 37** in response to the operation combination of the plural operation switches. Thus, the modified example can generate larger number of the percussive tones as compared to that in the present embodiment.

Incidentally, the present embodiment is configured such that the tone color control table 37 outputs the tone color control signal indicative of the kind of percussive tone to the musical tone signal generating circuit 38 which then generates the musical tone signal corresponding to the percussive tone. Instead, it is possible to modify the present embodiment such that the tone color control table 37 outputs the tone color control signal indicative of the musical instrument other than the percussion instrument, such as a piano, a guitar and the like. In this case, the musical tone signal generating circuit 38 generates the musical tone signal corresponding to the musical instrument other than the percussion instrument.

(3) In the present embodiment, the sticks 10A, 10B and leg rings 20A, 20B are respectively equipped with the acceleration sensors **11*a*, 11*b*, 22*a*, 22*b*. Instead of the acceleration sensors, it is possible to provide speed sensors for detecting the speeds accompanied with the spatial displacements of 10A, 10B, 20A, 20B. Or, it is possible to provide displacement sensors for detecting the displacements from the reference positions, accompanied with the spatial displacements of 10A, 10B, 20A, 20B**. By use of these speed sensors or displacement sensors, it is also possible to enjoy the music corresponding to the motions of the whole body in the dance or rhythm exercise.

Incidentally, the output signals of the acceleration sensors 11*a*, 11*b*, 22*a*, 22*b* are used for merely controlling the generation of the musical tone. Instead, it is possible to use these output signals as touch response signals by which the musical parameters such as the tone pitch can be controlled. This modified example can control the musical parameters of the musical tone in various manner, so that it can perform the music full of much variety.

(4) In the present embodiment, each acceleration sensor is provided with each A/D converter and each comparator. Instead, it is possible to provide only one pair of the A/D converter and comparator commonly used for all of the acceleration sensors 11*a*, 11*b*, 22*a*, 22*b* by use of the time-sharing system.

The present embodiment contains the A/D converters 35*a* to 35*d* and comparators 36*a* to 36*d* within the case 34 fixed to the belt 30. Instead, it is possible to provide the A/D converter and comparator to the stick or leg ring. In this case, the key-on signals KO1 to KO4 are directly supplied to the belt 30 via the leads 14*a*, 14*b*, 23*a*, 23*b*.

(5) The present embodiment transmits the detection signals from the acceleration sensors 11*a*, 11*b*, 22*a*, 22*b* via the leads 14*a*, 14*b*, 23*a*, 23*b*. Instead of these leads, it is possible to modify the present embodiment such that the detection signals are transmitted by wireless.

In this modified example, it is unnecessary to contain the A/D converters, comparators, tone color control table and musical tone signal generating circuit within the case 34 fixed to the belt 30. Therefore, the device containing these several circuits can be positioned in the vicinity of the person who performs the rhythm exercise.

Lastly, this invention may be practiced or embodied in still other ways without departing from the spirit or essential character thereof as described heretofore. Therefore, a preferred embodiment described herein is illustrative and not restrictive, the scope of the invention being indicated by the appended claims and all variations which come within the meaning of the claims ar intended to be embraced therein.

What is claimed is:

1. A musical tone control apparatus comprising:

(a) a stick having a shape which can be held by a person's hand, said stick being provided with a first sensor and at least one switch, said first sensor detecting a physical parameter accompanied with a spatial displacement of said stick to be moved with a free motion of a person's arm;

(b) detecting means to be mounted to a person's leg, said detecting means being provided with a second sensor for detecting a physical parameter accompanied with a spatial displacement of said detecting means in any of plural directions moved with a free ranging motion of the person's leg;

(c) musical tone generation control means for generating first and second musical tone generation control signals for controlling generation of musical tones which are respectively assigned to said stick and said detecting means based on detection results of said first and second sensors; and (d) tone control means for generating a tone color control signal for independently controlling tone colors of the musical tones, whose generation are controlled by said first and second musical tone generation control signals, in response to an operation of said switch.

2. A musical tone control apparatus comprising:

(a) a pair of sticks each having a shape which can be held by a person's hand, each of said sticks being provided with a first sensor and at least one switch, said first sensor detecting a physical parameter accompanied with a spatial displacement of said stick to be moved within a motion of a person's arm;

(b) a pair of detecting means each mounted to a person's leg, each of said detecting means being provided with a second sensor for detecting a physical parameter accompanied with a spatial displacement of said detecting means to be moved with a motion of the person's leg;

(c) musical tone generation control means for generating first through fourth musical tone generation control signals each controlling generation of a musical tone based on each of detection results of said first and second sensors; and (d) toner color control means for generating a tone color control signal for independently controlling tone colors of said first through fourth musical tones whose generation are controlled by said first through fourth musical tone generation control signals in response to a combination of operations of said switches which are provided to said sticks.

3. A musical tone control apparatus according to claim 1 or 2 wherein each of said first and second sensors is constructed by an acceleration sensor which detects an acceleration as said physical parameter.

4. A musical tone control apparatus according to claim 1 or 2 wherein at least one of said musical tones is a percussive tone corresponding to a percussion instrument.

5. A musical tone control apparatus comprising:

(a) a stick having a shape which can be held by a person's hand, said stick being provided with a first acceleration sensor and at least one switch, said first acceleration sensor detecting an acceleration applied to said stick to be moved with a free ranging motion of a person's arm;

(b) detecting means to be mounted to a person's leg, said detecting means being provided with a second acceleration sensor for detecting an acceleration applied to said detecting means to be moved in any of plural directions with a free ranging motion of the person's leg;

(c) means for generating a first key-on signal when the acceleration detected by said first acceleration sensor exceeds over a first predetermined value and a second key-on signal when the acceleration detected by said second acceleration sensor exceeds over a second predetermined value, wherein said first predetermined value is set different from said second predetermined value;

(d) musical tone generation means for generating a first musical tone in response to said first key-on signal and a second musical tone in response to said second key-on signal; and (e) tone color control means for independently controlling the tone colors of said first and second musical tones in response to an operation of said switch, whereby the musical tone having a desirable tone color is generated in accordance with said key-on signal.

6. A musical tone control apparatus according to claim 1, wherein said tone color control means generates tone color control signals which respectively and simultaneously control tone controls of said musical tones in response to an operation of said switch.

7. A musical tone control apparatus according to claim 6, wherein said tone color control means sets tone colors which number is larger than the number of said switches, so that said tone color control means controls the tone colors of said musical tones.

8. A musical tone control apparatus according to claim 2, wherein said tone color control means sets tone colors which number is larger than the number of said switches, so that said tone color control means controls the tone colors of said musical tones.

* * * * *